US007310038B2

(12) United States Patent
Marquardt et al.

(10) Patent No.: US 7,310,038 B2
(45) Date of Patent: Dec. 18, 2007

(54) ELECTROMECHANICAL DEVICE FOR SELECTING COIL VOLTAGE AND LOCKING THE COIL IN PLACE

(75) Inventors: Terry L. Marquardt, Brookfield, WI (US); Christian H. Passow, Enfield, NH (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 448 days.

(21) Appl. No.: 11/128,601

(22) Filed: May 13, 2005

(65) Prior Publication Data

US 2005/0212631 A1 Sep. 29, 2005

Related U.S. Application Data

(62) Division of application No. 10/924,016, filed on Aug. 23, 2004, now Pat. No. 7,271,692.

(60) Provisional application No. 60/506,837, filed on Sep. 29, 2003, provisional application No. 60/507,066, filed on Sep. 29, 2003.

(51) Int. Cl.
*H01H 47/00* (2006.01)
*H01H 9/00* (2006.01)

(52) U.S. Cl. ..... 336/192; 336/142

(58) Field of Classification Search ..... 336/139–149, 336/156, 162, 192
See application file for complete search history.

(56) References Cited

U.S. PATENT DOCUMENTS 3,461,379 A * 8/1969 Okita ..... 323/340
3,483,545 A * 12/1969 Trouilhet ..... 340/654
4,620,164 A * 10/1986 Kameya ..... 333/139
4,644,112 A * 2/1987 Kranich, II ..... 200/16 F
5,057,809 A * 10/1991 Chandler et al. ..... 336/144
5,159,545 A * 10/1992 Lee ..... 363/146
5,283,728 A * 2/1994 Hobart ..... 363/100
5,973,948 A * 10/1999 Hahn et al. ..... 363/146
6,002,246 A * 12/1999 Gohkon et al. ..... 323/359

* cited by examiner

*Primary Examiner*—Elvin Enad
*Assistant Examiner*—Bernard Rojas

(57) ABSTRACT

A system for selecting coil voltage in an electrical device comprises a housing and a coil in the housing having a plurality of windings. Each winding has a pair of pins. A slider supports a plurality of moveable contacts and is moveably mounted in the housing proximate the coil so that the plurality of moveable contacts selectively make or break electrical contact between the winding pins to select coil voltage.

10 Claims, 8 Drawing Sheets

ELECTROMECHANICAL DEVICE FOR SELECTING COIL VOLTAGE AND LOCKING THE COIL IN PLACE

DIVISIONAL PATENT APPLICATION

The present application is a divisional patent application of patent application Ser. No. 10/924,016 filed on Aug. 23, 2004 now U.S. Pat. No. 7,271,692, of Marquardt et al. for "Slider for Selecting Coil Voltage and locking the Coil in Place".

CROSS-REFERENCES TO RELATED APPLICATIONS

This application claims priority to, and incorporates by reference herein in its entirety, pending U.S. Provisional Patent Application Ser. No. 60/506,837 , filed 29 Sep. 2003 and pending U.S. Provisional Patent Application Ser. No. 60/507,066, filed 29 Sep. 2003.

FIELD OF THE INVENTION

The present invention relates to an electromechanical device having a selectable coil voltage and, more particularly, to a slider for selecting coil voltage and locking the coil in place.

BACKGROUND OF THE INVENTION

A conventional electrical switching apparatus in one known form comprises an electromagnetically actuable device having a magnetic core proximate an armature. Typically, a coil is electrically energized to draw the armature to the magnetic core. The electromagnetically actuated device may be a control relay, a contactor, a motor starter and the like. The armature is operatively associated with a moveable device such as an actuator. With an electrical switching apparatus, the actuator operates a contact assembly.

The electrical coil is typically rated for a select voltage. This requires having distinct coils for different voltage ratings. Certain electrical switching apparatus include dual voltage coils. For example, the coil might have two windings each rated at 120 volts. Commonly, wires are used for selectively connecting the terminals in series or parallel connection to provide 240 volt operation or 120 volt operation. Select electrical switching apparatus use jumpers for connections between winding terminals. The coil is typically secured in place using screws or spring clips, or the like.

With conventional electrical switching apparatus, as described, substantial numbers of parts might be required to satisfy all of the different variations. Also, the various screws and jumpers, and the like, can be misplaced during installation or repair.

The present invention is directed to improvements in electromechanical devices.

SUMMARY OF THE INVENTION

In accordance with the invention, there is provided a system and method for selecting coil voltage and locking a coil in place in an electrical device.

Broadly, there is disclosed a system for selecting coil voltage in an electrical device comprising a housing and a coil in the housing having a plurality of windings. Each winding has a pair of pins. A slider supports a plurality of moveable contacts and is moveably mounted in the housing proximate the coil so that the plurality of moveable contacts selectively make or break electrical contact between the winding pins to select coil voltage.

It is a feature of the invention that the slider is moveable between one position wherein the moveable contacts electrically connect the windings in series and another position wherein the moveable contacts electrically connect the windings in parallel. The slider is also moveable to a middle position wherein the windings are disconnected.

It is a further feature of the invention that the slider includes a plurality of ribs and the housing includes a plurality of slots so that if the slider is in an unlocked position, the ribs are aligned with the slots and if the slider is in a locked position, the ribs are not aligned with the slots and are engageable with the housing to selectively lock the coil in the housing. The one and the another positions comprise a locked position and the middle position comprises the unlocked position.

It is a further feature of the invention that the coil and slider include engageable detents to maintain the slider and select make or break positions.

It is a further feature of the invention that the moveable contacts comprise torsion springs or leaf springs.

It is yet another feature of the invention that the coil comprises an encapsulated coil.

There is disclosed in accordance with a further aspect of the invention an electromechanical device having a selectable coil voltage comprising a housing. A coil in the housing has first and second windings. Each winding has a pair of pins. An electromagnet is associated with the coil in the housing for driving an actuator responsive to energization of the coil. A slider supports a plurality of moveable contacts and is moveably mounted to the coil so that the plurality of moveable contacts selectively make or break electrical contact between the winding pins to select coil voltage.

There is disclosed in accordance with yet another aspect of the invention the method of selecting coil voltage in an electrical device comprising: providing a coil in a housing, the coil having a pair of windings, with each winding having a pair of pins; and slidably mounting a slider to the coil, the slider supporting a pair of moveable contacts, so that the pair of moveable contacts selectively make or break electrical contact between the winding pins to select coil voltage responsive to position of the slider.

Further features and advantages of the invention will be readily apparent from the specification and from the drawings.

DETAILED DESCRIPTION OF THE INVENTION

Figure 1:
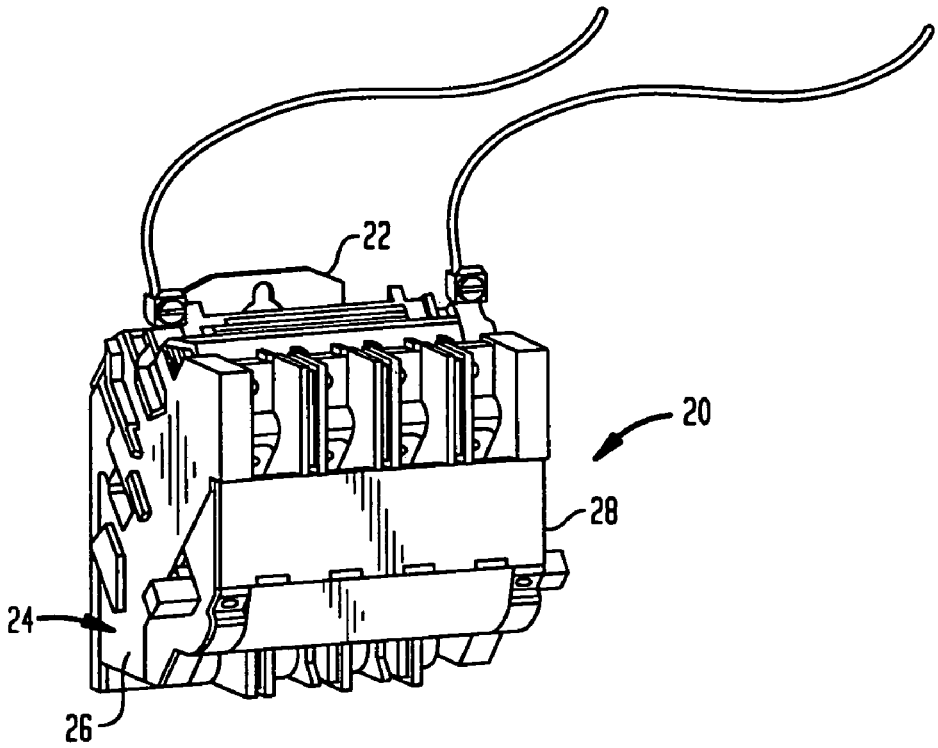
FIG. 1 is a perspective view of an electromechanical device having a selectable coil voltage in accordance with the invention.

Referring to FIG. 1, an electrical device such as an electromechanical switching apparatus in the form of an electrical contactor 20 is illustrated. The contactor 20 comprises a system and method for selecting coil voltage and locking the coil in place in accordance with the invention.

Figure 2:
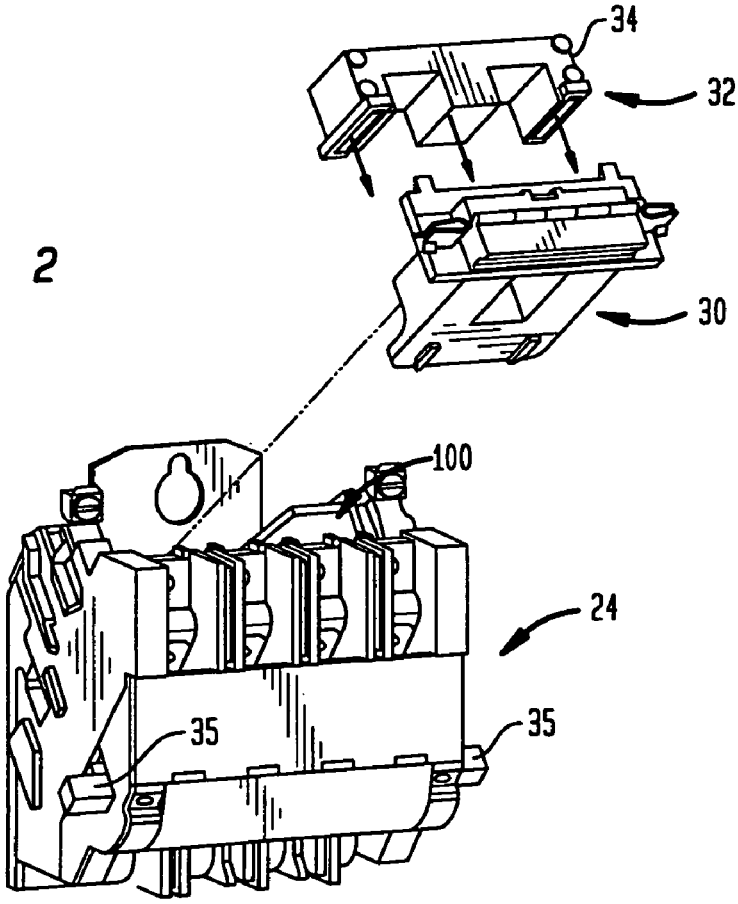
FIG. 2 is a perspective view, similar to FIG. 1, illustrating installation of a coil and magnet in the electromechanical device.

The contactor 20 is an electromagnetically actuable device and includes a mounting plate 22 for mounting in a control panel or the like. A main housing 24 is mounted to the mounting plate 22. The main housing 24 includes a base 26 and cover 28. Referring also to FIG. 2, the main housing 24 encloses an electrical coil 30 associated with an electromagnet 32. The electromagnet includes a magnetic core 34 and conventional armature (not shown). As is conventional, energization of the coil 30 draws the armature to the magnetic core 34 for driving an actuator having opposite ends 35. Additionally, the main housing 24 encloses various electrical contacts (not shown) which can be opened or closed by the actuator 34 responsive to energization of the coil, as is conventional.

The present invention is not limited to the electrical contactor 20 illustrated herein. Instead, the present invention relates to a system and method for selecting coil voltage and locking a coil in place in an electrical device. This invention may be applied to at least electromechanical contactors, transformers and sensors, which use multiple voltage coils.

Figure 3:
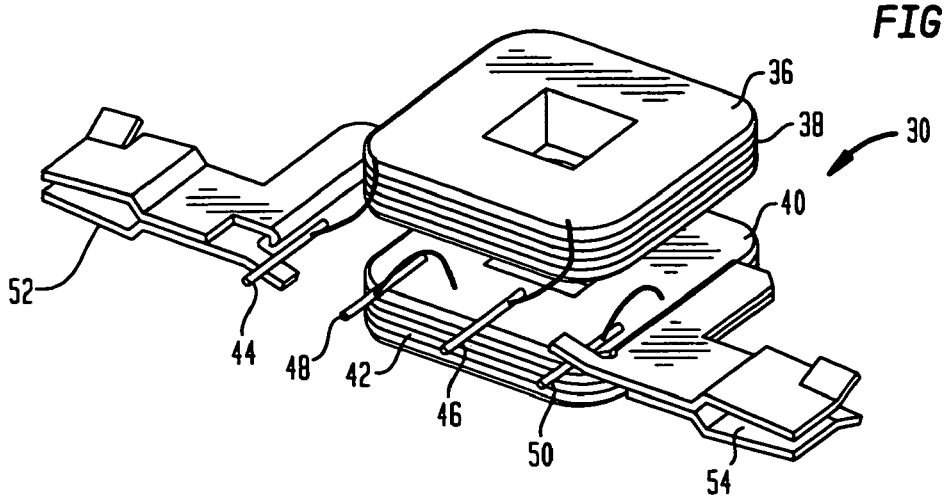
FIG. 3 is a perspective view of the coil prior to encapsulation.

Referring to FIG. 3, the coil 30 is illustrated prior to encapsulation. The coil 30 comprises a first bobbin 36 having a first winding 38. A second bobbin 40 includes a second winding 42. Opposite ends of the first winding 38 are connected to a start pin 44 and finish pin 46. Opposite ends of the second winding 42 are connected to a start pin 48 and a finish pin 50. As will be appreciated, a one piece bobbin could be used for both windings 38 and 42. The pins are aligned as illustrated in the sequence 44, 48, 46 and 50. The first winding start pin 44 is connected to a first coil terminal 52. The second winding finish pin 50 is connected to a second coil terminal 54. The coil terminals 52 and 54 comprise coil clips in the illustrated embodiment of the invention. The coil terminals 52 and 54 are used for connecting to an external control voltage source.

Figure 4:
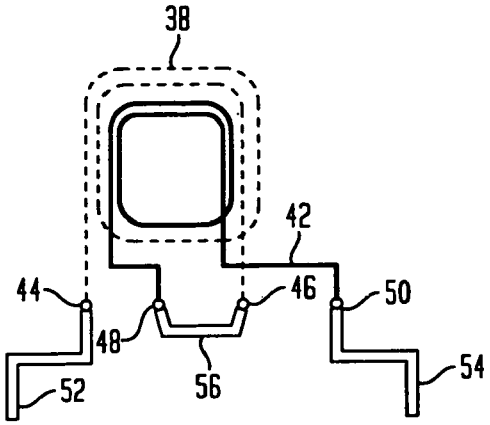
FIG. 4 is an electrical schematic of the coil of FIG. 3 with windings connected in series.
Figure 5:
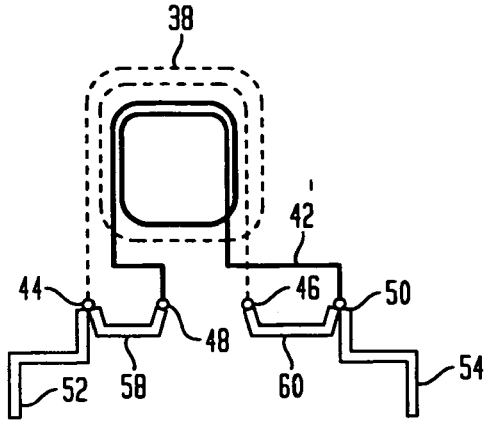
FIG. 5 is an electrical schematic of the coil of FIG. 3 with the windings connected in parallel.

In an exemplary embodiment of the invention, each winding 38 and 42 could be designed to operate at 120 volts AC. If the windings 38 and 42 are connected in series, as illustrated in FIG. 4, by connecting the second winding start pin 48 to the first winding finish pin 46 using a connector 56, a 240 AC coil is provided. Alternatively, if the windings 38 and 42 are connected in parallel, as illustrated in FIG. 5, by connecting the first winding start pin 44 to the second winding start pin 48, using a connector 58, and the first winding finish pin 46 to the second winding finish pin 50, using a connector 60, 120 volt AC operation is provided. As is apparent, different voltages could be used, as necessary or desired.

Figure 6:
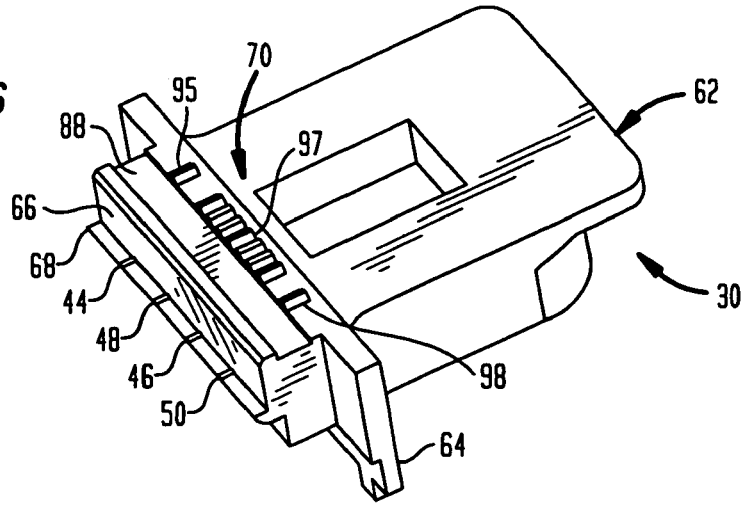
FIG. 6 is a perspective view of the encapsulated coil, with coil terminals omitted for clarity.

FIG. 6 illustrates the coil 30 encapsulated in a plastic housing 62. The plastic housing 62 is in the form of a rectangular donut shape including an enlarged front shoulder 64. A wall 66 extends forwardly of the front shoulder. The pins 44, 48, 46 and 50 extend outwardly of the wall 66 and rest on a ledge 68. A plurality of detents 70 are provided atop the shoulder 64.

Figure 7:
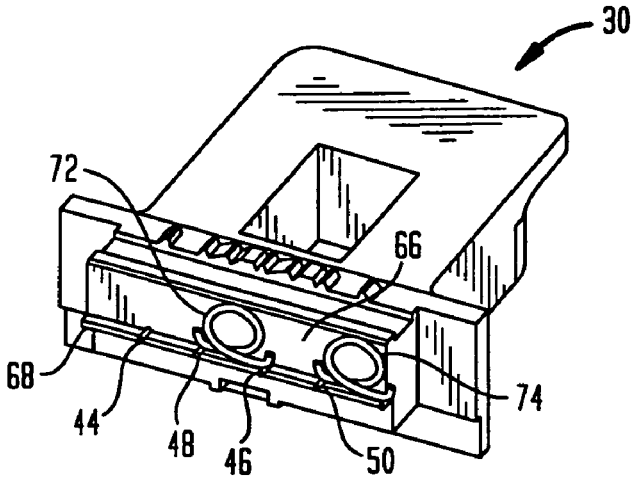
FIG. 7 is a perspective view, similar to FIG. 6, illustrating torsion spring moveable contacts operative associated with the coil.
Figure 8:
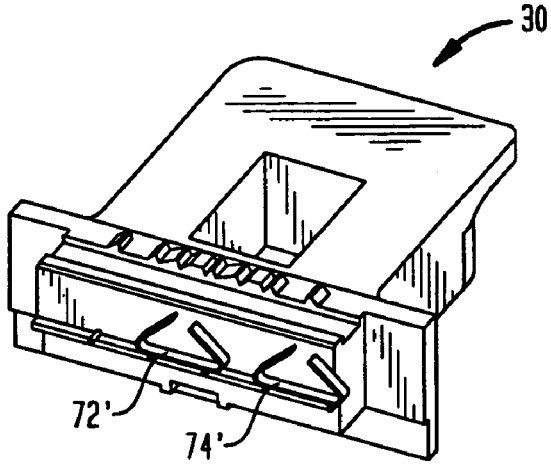
FIG. 8 is a perspective view similar to FIG. 6 illustrating leaf spring moveable contacts operatively associated with the coil.

Referring to FIG. 7, first and second torsion spring moveable contacts 72 and 74 are illustrated proximate the wall 66 and carried on the ledge 68. The moveable contacts 72 and 74 are slidable along the wall 66, as described below, to make or break electrical contact between the winding pins 44, 48, 46 and 50 to select coil voltage. Referring to FIG. 8, the coil 30 is illustrated with leaf spring moveable contacts 72' and 74'. The leaf spring moveable contacts 72' and 74' operate similar to the torsion spring moveable contacts 72 and 74.

Figure 9:
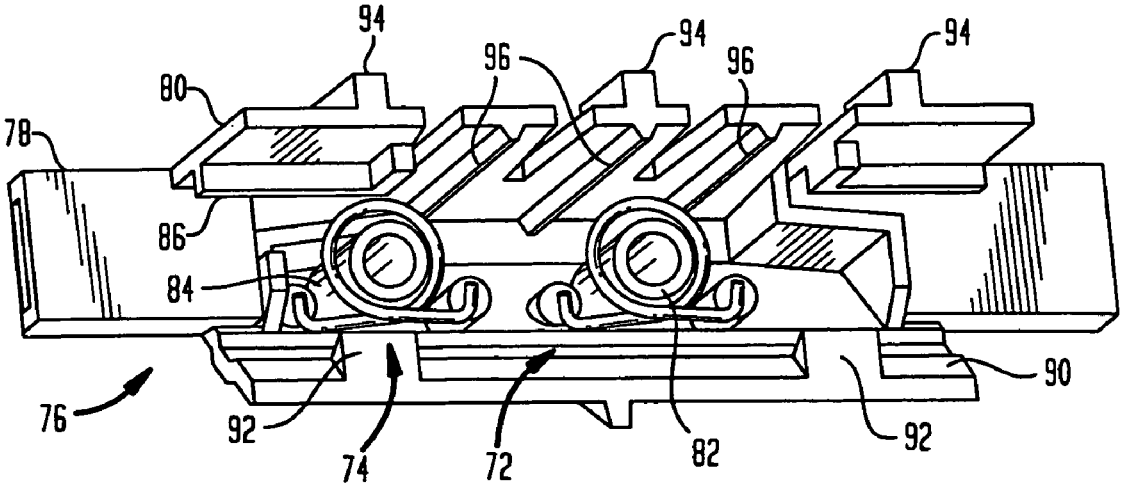
FIG. 9 is a rear perspective view of a slider supporting the torsion spring moveable contacts.
Figure 10:
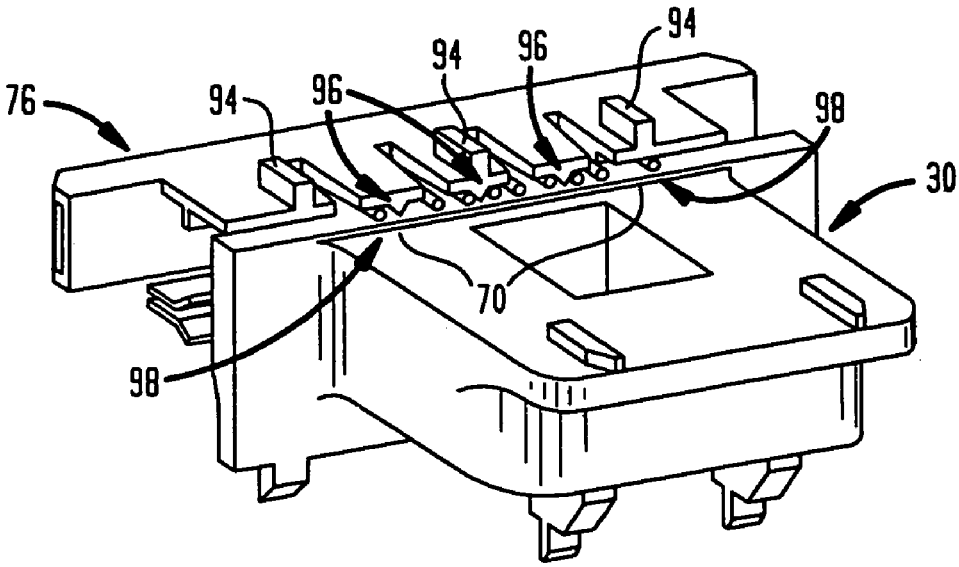
FIG. 10 is a rear perspective view illustrating the slider moveably mounted to the coil.

Referring to FIG. 9, a slider 76 in accordance with the invention is illustrated. The slider 76 is of one piece plastic construction and includes a front wall 78 and top wall 80. First and second hubs 82 and 84 extend rearwardly from the front wall 78. The first hub 82 supports the first moveable contact torsion spring 72. The second hub 84 supports the second moveable contact torsion spring 74. Extending downwardly from the top wall 80 is a ridge 86 to be received in a groove 88, see FIG. 6, atop the coil wall 66 forwardly of the detents 70. A support member 90 extends diagonally rearwardly from the bottom of the front wall 78 and includes a pair of steps 92 to be received below the ledge 68, see FIG. 6. The combination of the steps 92 engaging the ledge 68 and the ridge 86 received in the groove 88 slidably mounts the slider 76 to the coil 30, as illustrated in FIG. 10.

Three ribs 94 extend upwardly from the slider top wall 80 for locking the coil 30 in the housing 24, as described below. A plurality of detents 96 extends downwardly from the top wall 80 and are selectively engageable with the coil detents 70, as illustrated in FIG. 10, to create four distinct positions in which the slider 76 can be located relative to the coil 30. Also, the coil detents 70 include stop detents 98 at opposite ends which limit lateral movement of the slider 76 relative to the coil 30. This prevents the slider 76 from falling off the coil 30.

Figure 11:
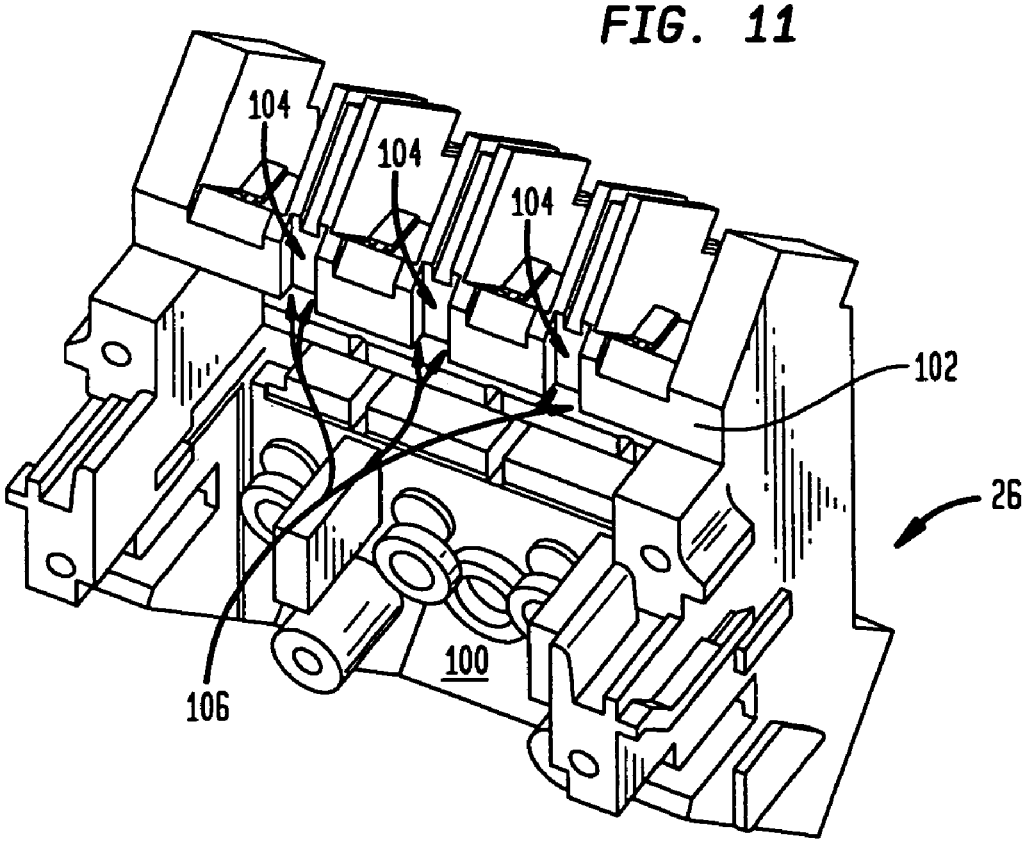
FIG. 11 is a rear perspective view of a portion of the housing of the electromechanial device illustrating a cavity for receiving the slider and coil.

Referring to FIG. 11, the housing base 26 is illustrated in greater detail. The housing base 26 defines a space or cavity 100, see also FIG. 2, for receiving the coil 30. The contactor 20 also is adapted for connecting the removable coil 30 to fixed coil terminals as described in our co-pending application No. 60/507,066 filed concurrently with the present application and assigned to the Assignee of the present invention, the specification of which is incorporated by reference herein. A wall 102 defining an opening into the space 100 includes three slots 104 through which the slider ribs 94 pass while the coil 30 is being inserted. A rear side of the wall 102 includes surfaces 106 with which the slider ribs 94 engage after the coil 30 is inserted and the slider 76 is moved to a locked position, as described below.

As described above, the slider 76 is moveably mounted to the coil 30. The slider hubs 82 and 84 support the moveable contacts 72 and 74, respectively, above the ledge 68, as shown in FIG. 7, so that the moveable contacts 72 and 74 selectively make or break contact between the winding pins 44, 46, 48 and 50 to select coil voltage. Particularly, the coil detents 70 in combination with the slider detents 96 define four discrete positions. Generally, the first position comprises a locked position with the windings connected in parallel. The second position comprises an unlocked left position with no pins connected. The third position comprises an unlocked right position with no pins connected. Finally, the fourth position comprises a locked position with the windings connected in series. As is apparent, the detents 70 could be configured to define three discrete positions with a center unlocked position. By using two unlocked positions, the slider provides an indication to the user as to the intended application. For example, the second position can be used to indicate that the coil to be used is intended to connect the windings in parallel. Similarly, the third position can be used to indicate that the coil is intended to connect the windings in series. As such, a heavier detent 97, see FIG. 6, is supplied in the center of the coil detents 70 to make it more difficult to move between the second and third positions. The following figures illustrate the specific location of the slider 76 relative to the coil 30 and the corresponding location of the moveable contacts relative to the pins and the particular lock and unlocked positions.

Figure 12A:
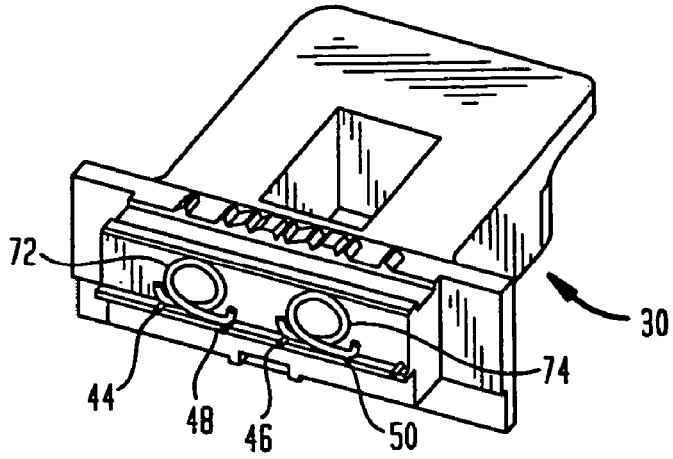
FIGS. 12A-12C illustrate the moveable contacts and slider in a locked, parallel connection position.
Figure 12B:
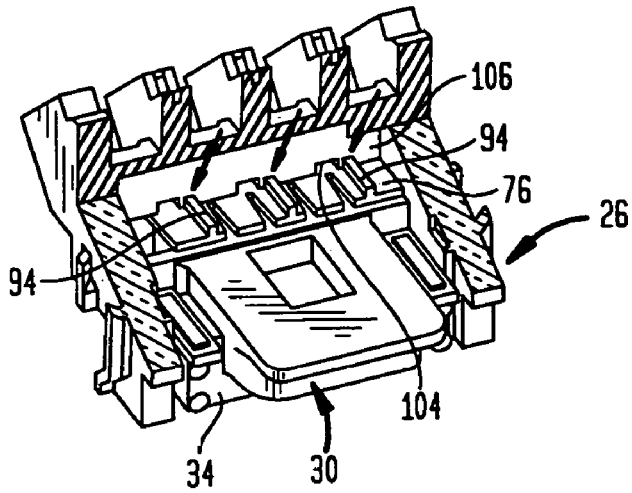
Figure 12C:
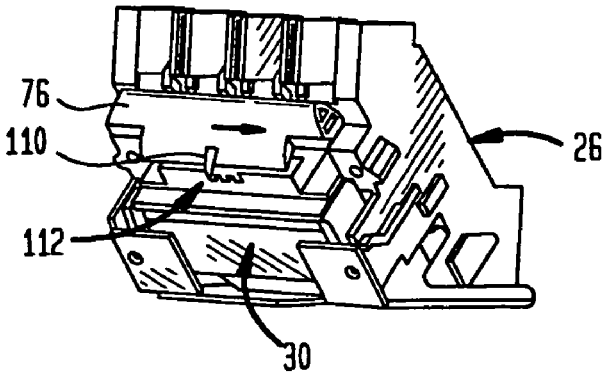

FIGS. 12A, 12B and 12C illustrate the first position. Referring initially to FIG. 12A, in the first position, the first moveable contact 72 provides a conductive bridge between the winding start pins 44 and 48. The second moveable contact 74 provides a conductive bridge between the winding finish pins 46 and 50. This provides a parallel connection between the windings 38 and 42, as illustrated schematically in FIG. 5. FIG. 12C illustrates the slider 76 relative to the coil 30 being in a far left position as indicated by a pointer 110 on the slider 76 pointing to an indicator 112 on the coil 30. In this position, the slider ribs 94 are engaging the housing wall surface 106, as illustrated in FIG. 12B, with the enlarged arrows so that the coil 30, magnetic core 34 and slider 76 are locked into the housing base 26.

Figure 13A:
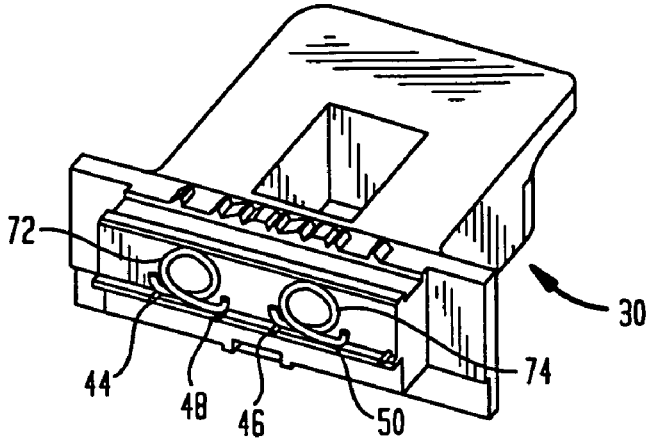
FIGS. 13A-C illustrate the moveable contacts and slider in an unlocked left position.
Figure 13B:
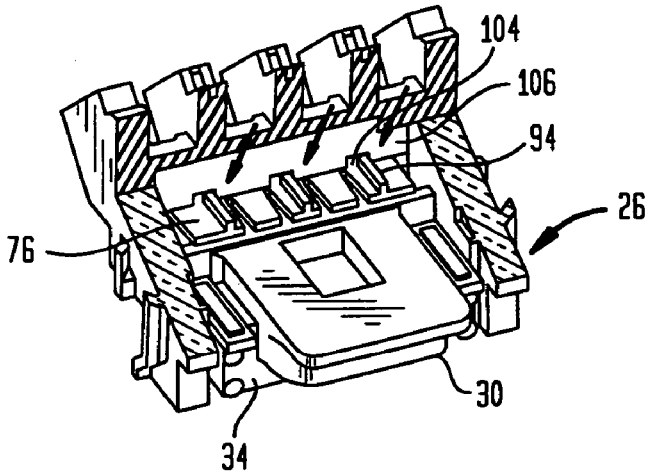
Figure 13C:
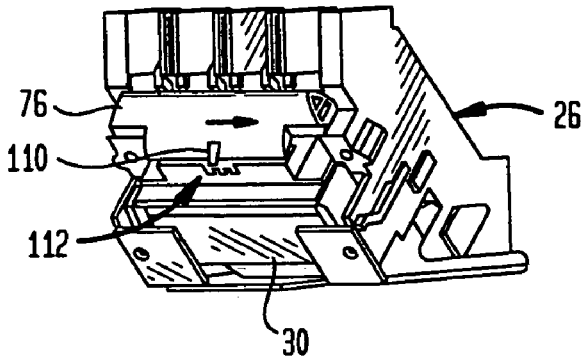

FIGS. 13A, 13B and 13C illustrate the second position. This is a deadzone position disconnected from the parallel connection position. The second position may result from moving the slider to the right from the first position. Referring initially to FIG. 13A, in the second position, the first moveable contact 72 breaks from the first winding start pin 44 and contacts only the second winding start pin 48. The second moveable contact 74 breaks from the first winding finish pin 46 and contacts only the second winding finish pin 50. This provides no connection between the windings 38 and 42. FIG. 13C illustrates the slider 76 relative to the coil 30 being in the second position as indicated by the pointer 110 pointing to the indicator 112 on the coil 30. In this position, the slider ribs 94 are aligned with the slots 104, as illustrated in FIG. 13B with the enlarged arrows so that the coil 30, magnet 34 and slider 76 are unlocked from the housing base 26 and can be removed from the cavity 100.

Figure 14A:
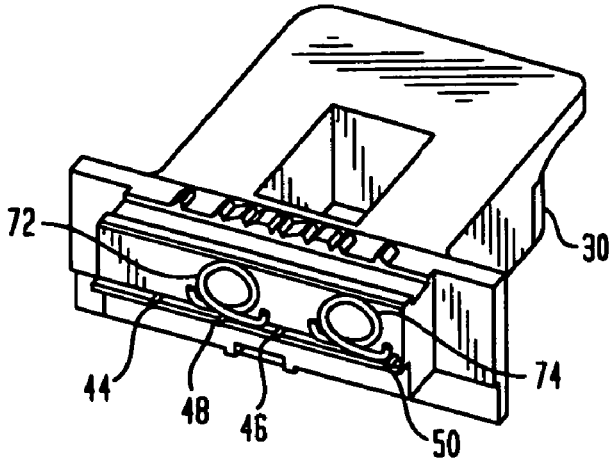
FIGS. 14A-C illustrate the moveable contacts and slider in an unlocked right position.
Figure 14B:
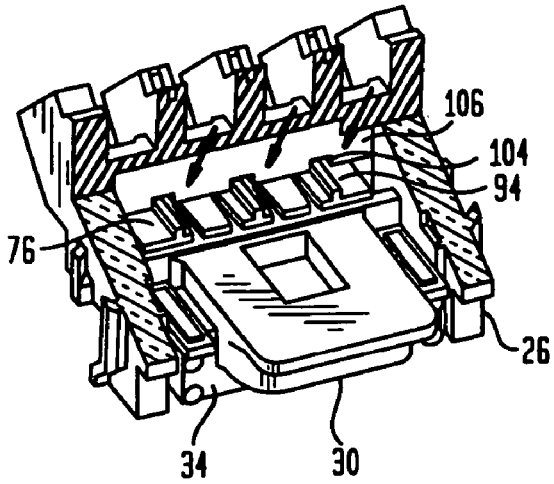
Figure 14C:
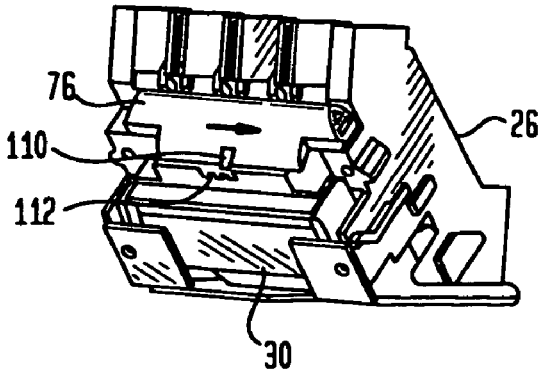

FIGS. 14A, 14B and 14C illustrate the third position. This is a deadzone position disconnected from the series connection position. The third position may result from moving the slider to the left from the fourth position, discussed below. Referring initially to FIG. 14A, in the third position, the first moveable contact 72 breaks from the first winding finish pin 46 and contacts only the second winding start pin 48. The second moveable contact 74 contacts only the second winding finish pin 50. This provides no connection between the windings 38 and 42. FIG. 14C illustrates the slider 76 relative to the coil 30 being in the third position as indicated by the pointer 110 pointing to the indicator 112 on the coil 30. In this position, the slider ribs 94 are aligned with the slots 104, as illustrated in FIG. 14B with the enlarged arrows so that the coil 30, magnet 34 and slider 76 are unlocked from the housing base 26 and can be removed from the cavity 100.

Figure 15A:
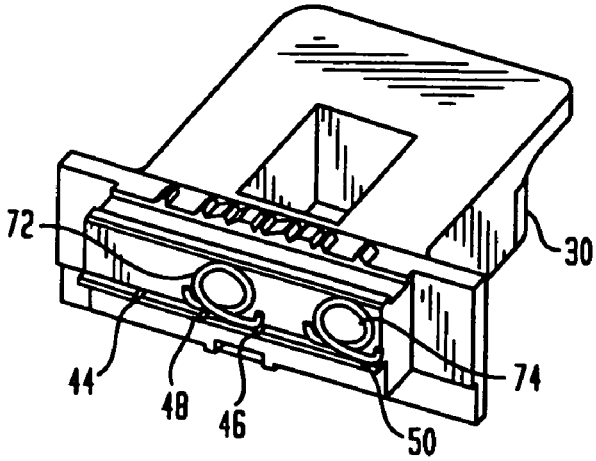
FIGS. 15A-C illustrate the moveable contacts and slider in a locked series connection position.
Figure 15B:
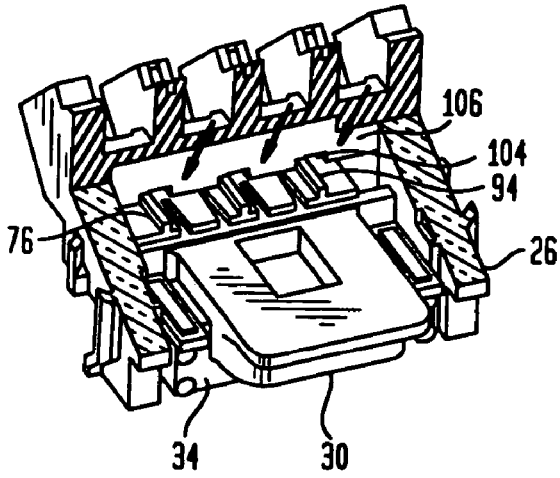
Figure 15C:
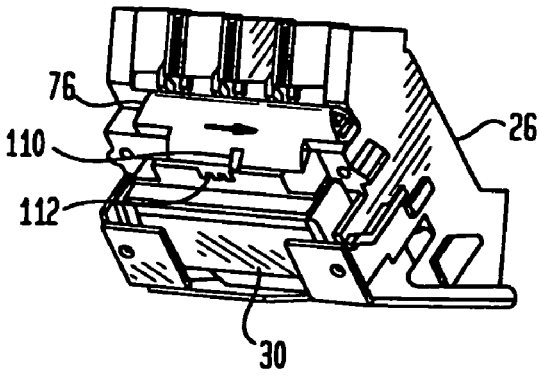

FIGS. 15A, 15B and 15C illustrate the fourth position. Referring initially to FIG. 15A, in the fourth position, the first moveable contact 72 provides a conductive bridge between the first winding finish pin 46 and the second winding start pin 48. The second moveable contact 76 is connected only to the second winding finish pin 50. This provides a series connection between the windings 38 and 42, as illustrated schematically in FIG. 4. FIG. 15C illustrates the slider 76 relative to the coil 30 being in a far right position as indicated by the pointer 110 pointing to the indicator 112. In this position, the slider ribs 94 are engaging the housing wall surface 106, as illustrated in FIG. 15B with the enlarged arrows so that the coil 30, magnetic core 34 and slider 76 are locked into the housing base 26.

In the illustrated embodiment of the invention, the slider 76 is moveable between one position, the first position, wherein the moveable contacts 72 and 74 electrically connect the windings 38 and 44 in parallel, two middle positions, the second and third positions, wherein the windings 38 and 42 are disconnected and another position, the fourth position, wherein the moveable contacts 72 and 74 electrically connect the windings 38 and 42 in series. As is apparent, the slider 76 could use a single middle position rather than two distinct middle positions to provide the unlock, disconnect function.

Thus, in accordance with the invention, there is provided a system and method of selecting coil voltage in an electrical device using a slider on the coil which also is used to lock the coil in place.

We claim:

1. An electromechanical device having a selectable coil voltage comprising:

a housing;

a coil in the housing having first and second windings, each winding having a pair of pins;

an electromagnet associated with the coil in the housing for driving an actuator responsive to energization of the coil;

a pair of moveable contacts; and a slider supporting the pair of moveable contacts and being moveably mounted to the coil so that the plurality of moveable contacts selectively make or break electrical contact between the winding pins to select coil voltage.

2. The electromechanical device of claim 1 wherein the slider is moveable between one position wherein the moveable contacts electrically connect the windings in series and another position wherein the moveable contacts electrically connect the windings in parallel.

3. The electromechanical device of claim 2 wherein the slider is moveable to a first or second middle position wherein the windings are disconnected.

4. The electromechanical device of claim 1 wherein the slider includes a plurality of ribs and the housing includes a plurality of slots so that if the slider is in an unlocked position the ribs are aligned with the slots and if the slider is in a locked position the ribs are not aligned with the slots and are engageable with the housing to selectively lock the coil and electromagnet in the housing.

5. The electromechanical device of claim 4 wherein the slider is moveable between one position wherein the moveable contacts electrically connect the windings in series, a middle position wherein the windings are disconnected and another position wherein the moveable contacts electrically connect the windings in parallel.

6. The electromechanical device of claim 5 wherein the one and the another positions comprise the locked position and the middle position comprises the unlocked position.

7. The electromechanical device of claim 1 wherein the coil and the slider include engageable detents to maintain the slider in selected make or break positions.

8. The electromechanical device of claim 1 wherein the moveable contacts comprise torsion springs.

9. The electromechanical device of claim 1 wherein the moveable contacts comprise leaf springs.

10. The electromechanical device of claim 1 wherein the coil comprises an encapsulated coil.

* * * * *